US006435450B1

(12) United States Patent
Shields et al.

(10) Patent No.: US 6,435,450 B1
(45) Date of Patent: Aug. 20, 2002

(54) MULTI-COMPARTMENT PARALLELING REEL HAVING INDEPENDENT COMPARTMENTS

(75) Inventors: John Shields, Glendale; Steve Szalay, La Vern; Cliff Thompson, Murrieta, all of CA (US)

(73) Assignee: Sasco Electric, Santa Ana, CA (US)

( * ) Notice: Subject to any disclaimer, the term of this patent is extended or adjusted under 35 U.S.C. 154(b) by 1 day.

(21) Appl. No.: 09/726,888

(22) Filed: Nov. 30, 2000

(51) Int. Cl.[7] ..... B65H 16/02; B65H 75/44

(52) U.S. Cl. ..... 242/594.3; 242/118.41; 242/388.6; 242/474.8

(58) Field of Search ..... 242/388.6, 390.8, 242/594.3, 594.4, 474.8, 476.1, 118.41

(56) References Cited

U.S. PATENT DOCUMENTS

| | | | | | |
|---|---|---|---|---|---|
| 782,709 | A | * | 2/1905 | Taubert | 242/118.4 |
| 1,593,781 | A | * | 7/1926 | See | 242/594.3 X |
| 3,086,720 | A | * | 4/1963 | Leach | 242/474.8 |
| 3,854,509 | A | * | 12/1974 | Bailey | 242/594.3 |
| 3,907,229 | A | * | 9/1975 | Iannucci et al. | 242/594.3 X |
| 4,208,021 | A | * | 6/1980 | Wall | 242/594.3 |
| 5,653,293 | A | * | 8/1997 | Ellis | 242/388.6 X |
| 5,915,947 | A | * | 6/1999 | Tomlinson | 242/594.3 X |

FOREIGN PATENT DOCUMENTS

| | | | |
|---|---|---|---|
| JP | 61-235370 | * 10/1986 | 242/594.3 X |

OTHER PUBLICATIONS

Reel–O–Matic; Reel–Neat Systems, Inc. catalog: pp. 50 & 65, dated 1997.

* cited by examiner

*Primary Examiner*—Michael R. Mansen
*Assistant Examiner*—Minh-Chau Pham
(74) *Attorney, Agent, or Firm*—Blakely Sokoloff Taylor & Zafman

(57) ABSTRACT

A multi-compartment paralleling reel that allows different sets of wire to be drawn from the paralleling reel independently of each other. The multi-compartment paralleling reel includes a plurality of independent compartments. Each independent compartment can store a set of wire. A shaft mounted through the plurality of independent compartments allows each independent compartment to rotate relative to the shaft and allows each independent compartment to rotate independently of the other independent compartments. Thus, each set of wire can be drawn from each independent compartment of the multi-compartment paralleling reel independently of the other independent compartments. This allows the different sets of wire, which may include wires that have different diameter sizes, to be drawn from the independent compartments at different rates of speed or the same speed, depending upon what is desired.

15 Claims, 4 Drawing Sheets

MULTI-COMPARTMENT PARALLELING REEL HAVING INDEPENDENT COMPARTMENTS

BACKGROUND

1. Field of the Invention

The present invention relates to the mechanical arts. In particular, the invention relates to a multi-compartment paralleling reel for allowing a plurality of different sets of wire to be drawn from the paralleling reel independently of each other.

2. Description of Related Art

Standard paralleling reels are well known in the art. Generally, electrical contractors use standard paralleling reels to install feeder wire, as well as other types of wiring, during the construction or maintenance of structures requiring electricity, such as buildings. For example, feeder wire is used as main electrical wiring to feed the electrical panels of buildings and typically has a large diameter. Standard paralleling reels can be composed of one large compartment having a hub and a pair of opposed rings at the hub's ends, which stores a single set of wire (wrapped around the hub), or multiple compartments formed by a plurality of rings dividing up the hub into multiple compartments each of which stores a different set of wire (wrapped around the hubs, respectively). Often, the standard paralleling reel is rotatably coupled to a platform by being fixedly mounted to a shaft, which is in turn rotatably coupled to the platform. Also, the standard paralleling reel is often motorized to aid in the loading of wire.

In the multiple compartments case, a worker typically draws a wire, by hand, from each of the multiple compartments, to install the wires. The multiple compartments are typically fixed onto the shaft of the standard paralleling reel such that the multiple compartments rotate together in unison. Thus, the multiple compartments all turn at the same time and at the same rate of speed. Accordingly, the different wires are released at whatever rate of speed that the multiple compartments are turning at. Unfortunately, it is often desirable for the workers to be able to pull the various wires from the different multiple compartments independently of one another at different rates of speed.

Additionally, it is often desirable for the workers to be able to pull wires having different diameter sizes from the different multiple compartments at the same rate of speed. However, when the diameter size of wire in one compartment differs from the diameter size of wire in other compartments, the various wires having differing diameter sizes are released at different rates of speed, which results in a significant loss of efficiency for the workers who are trying to pull the wires out in unison.

In view of the above, it should be appreciated that there is a need for a multi-compartment paralleling reel having independent compartments that allows the independent compartments to rotate independently of one another such that workers can draw the different sets of wire from the independent compartments at differing speeds. Particularly there is a need for a multi-compartment paralleling reel to allow workers to simultaneously unload different sets of wire having different diameter sizes at the same rate of speed. The present invention satisfies these and other needs and provides further related advantages.

SUMMARY

The present invention discloses a multi-compartment paralleling reel that allows different sets of wire to be drawn from the paralleling reel independently of each other. The multi-compartment paralleling reel includes a plurality of independent compartments. Each independent compartment can store a set of wire. A shaft mounted through the plurality of independent compartments allows each independent compartment to rotate relative to the shaft and allows each independent compartment to rotate independently of the other independent compartments, respectively. Thus, each set of wire can be drawn from each independent compartment of the multi-compartment paralleling reel independently of the other independent compartments. This allows the different sets of wire to be drawn from the independent compartments at different rates of speed or the same speed, depending upon what is desired. Accordingly, workers can unload different sets of wire having the same diameter size, or different diameter sizes, from the multi-compartment paralleling reel, at a desired speed, independently of one another and the other sets of wire. For example, workers can simultaneously unload different sets of wire having different diameter sizes at the same speed.

In one embodiment, the multi-compartment paralleling reel is rotatably coupled to a platform and is connected to a motor. The multi-compartment paralleling reel may further include a reel securing bar that extends transversely through the independent compartments to secure the independent compartments to one another. In this embodiment, the reel securing bar is used to secure the independent compartments to one another when different sets of wire are loaded onto the independent compartments, respectively. For example, the motor can be used to turn the independent compartments to load the wire. On the other hand, the reel securing bar is removed when the wire is unloaded. This allows the independent compartments to rotate independently of one another about the shaft such that workers can draw the different sets of wire, possibly having different diameter sizes, from the independent compartments at a desired speed. For example, workers can simultaneously unload different sets of wire having different diameter sizes at the same speed. This results in a significant increase in efficiency for workers trying to unload wires having different diameter sizes in unison.

Other features and advantages of the present invention will be set forth in part in the description which follows and the accompanying drawings, wherein the preferred embodiments of the present invention are described and shown, and in part will become apparent to those skilled in art upon examination of the following detailed description taken in conjunction with the accompanying drawings, or may be learned by the practice of the present invention. The advantages of the present invention may be realized and attained by means of the instrumentalities and combinations particularly pointed out in the appended claims.

BRIEF DESCRIPTION OF THE DRAWINGS

The features and advantages of the present invention will become apparent from the following description of the present invention in which.

DESCRIPTION

In the following description, the various embodiments of the present invention will be described in detail. However, such details are included to facilitate understanding of the invention and to describe exemplary embodiments for implementing the invention. Such details should not be used to limit the invention to the particular embodiments described because other variations and embodiments are possible while staying within the scope of the invention. Furthermore, although numerous details are set forth in order to provide a thorough understanding of the present invention, it will be apparent to one skilled in the art that these specific details are not required in order to practice the present invention. In other instances details such as, well-known mechanical design methods, procedures, mechanical components and structures, are not described in detail, or are shown in block diagram form, in order not to obscure the present invention.

The present invention discloses a multi-compartment paralleling reel that allows different sets of wire to be drawn from the paralleling reel independently of each other. The multi-compartment paralleling reel includes a plurality of independent compartments. Each independent compartment can store a set of wire. A shaft mounted through the plurality of independent compartments allows each independent compartment to rotate relative to the shaft and allows each independent compartment to rotate independently of the other independent compartments, respectively. Thus, each set of wire can be drawn from each independent compartment of the multi-compartment paralleling reel independently of the other independent compartments. This allows the different sets of wire to be drawn from the independent compartments at different rates of speed or the same speed, depending upon what is desired. Accordingly, workers can unload different sets of wire having the same diameter size, or different diameter sizes, from the multi-compartment paralleling reel, at a desired speed, independently of one another and the other sets of wire. For example, workers can simultaneously unload different sets of wire having different diameter sizes at the same speed.

Figure 1:
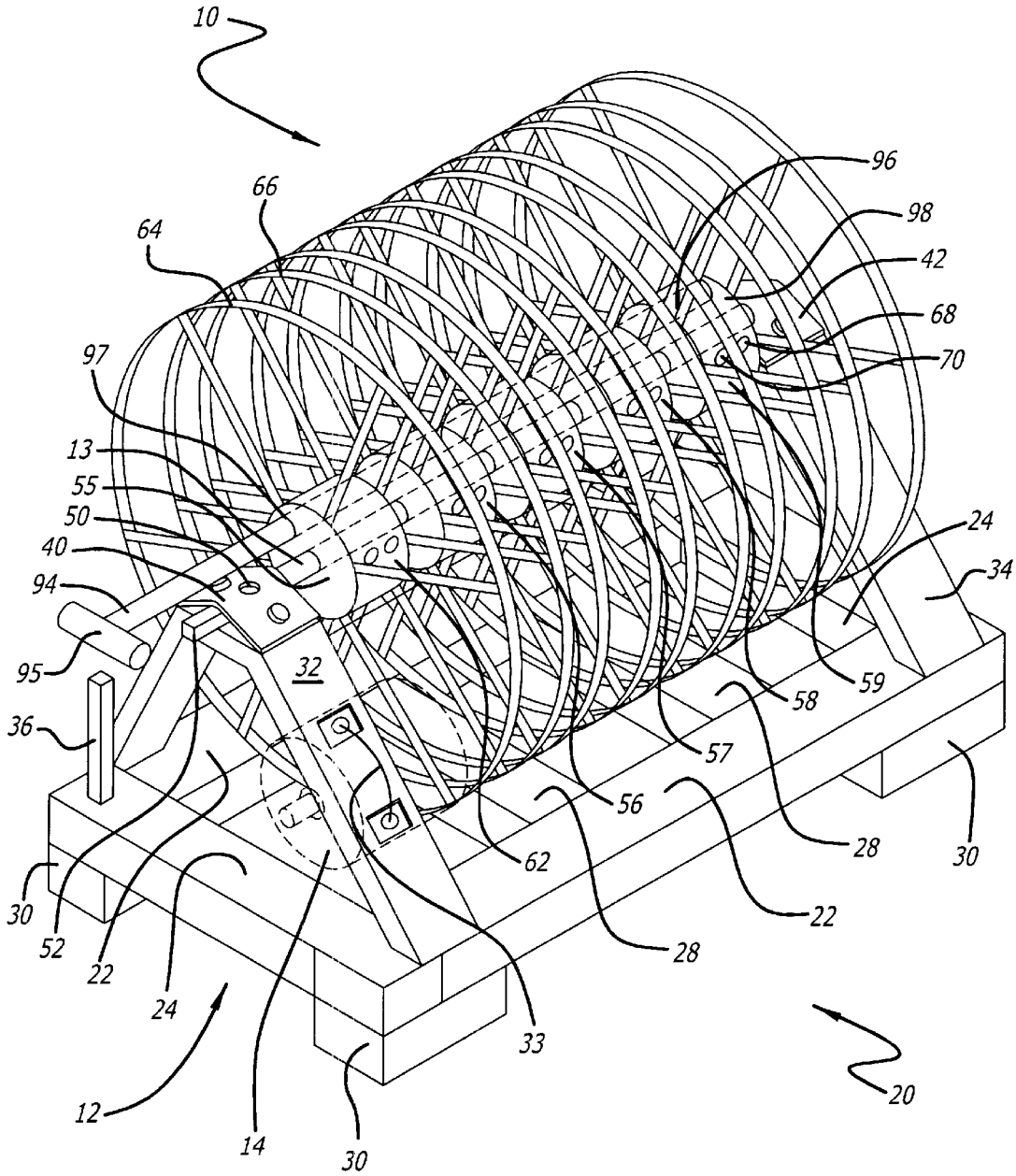
FIG. 1 is a perspective view of a multi-compartment paralleling reel according to one embodiment of the present invention.

FIG. 1 is a perspective view of a multi-compartment paralleling reel according to one embodiment of the present invention. As shown in FIG. 1, a multi-compartment paralleling reel 10 is rotatably coupled to a platform 12 by a shaft 13 and can be connected to a motor 14. As will be discussed, the multi-compartment paralleling reel 10 allows different sets of wire, which may include wires having different diameter sizes, to be drawn from independent compartments that rotate independently of one another about the shaft 13, at different rates of speed or the same speed, depending upon what workers operating the multi-compartment paralleling reel desire.

The platform 12 includes a rectangularly shaped base 20 having a first pair of opposed members 22 and a second pair of opposed members 24. Further, the rectangularly shaped base 20 includes a pair of cross-supports 28 mounted between the second pair of opposed members 24. Four base supports 30 (only three shown) depend perpendicularly from the rectangularly shaped base 20 and are used to support the platform against the ground. A pair of triangular supports 32 and 34 extend perpendicularly from the rectangularly shaped base 20. The triangular support 32 includes motor supports 33 to mount the motor 14 to the platform 12. The motor 14 may be a portable drive unit such as those produced by WAMCO Inc. Also, extending perpendicularly from the rectangularly shaped base 20 is a reel securing bar storage 36 that can be used for storing a reel securing bar, which will be discussed later.

At the top end of each triangular support 32 and 34, u-shaped pillow bearing shafts 40 and 42, respectively, rotatably mount the shaft 13 to the platform 12. The u-shaped pillow bearing shafts 40 and 42 may be connected to the triangular support by conventional means nut and bolt assembly, rivets, welding, etc. Each u-shaped pillow bearing shaft includes a type-2 pillow bearing (not shown), respectively, to rotatably couple the shaft 13 to the platform 12. Additionally each bracket includes a bearing oiler hole 50 (only one shown) to allow oil to be applied to the type-2 pillow bearing to ensure smooth rotation of the shaft 13 and the multi-compartment paralleling reel 10. The shaft 13 also includes a square motor shank 52 that is connected to the motor 14. The motor 14 can rotate the shaft 13 and the multi-compartment paralleling reel 10 such that wire can be loaded onto the multi-compartment paralleling reel 10.

The multi-compartment paralleling reel 10 includes a plurality of independent compartments 55, 56, 57, 58, and 59 and the shaft 13 to allow different sets of wire to be drawn from the multi-compartment paralleling reel independently of each other. Particularly, in this embodiment five independent compartments 55, 56, 57, 58, and 59 are shown. However, it should be appreciated that the multi-compartment paralleling reel 10 of the invention may have any number of independent compartments and this embodiment is only exemplary.

Each independent compartment includes a cylindrically shaped hub 62 and a pair of opposed rings 64 and 66, respectively. Each independent compartment can store a set of wire. The set of wire is stored by being wrapped around the hub 62 between the opposed rings 64 and 66. Each hub has two arbor holes 68 and 70 on each side (only two shown). A wire of a set of a wire can be looped through the arbor holes to fix the wire onto a hub. After fixing wires to hubs, the sets of wires can be loaded onto the hubs of the independent compartments, respectively, by the motor 14 turning the independent compartments of the multi-compartment paralleling reel 10, in unison, to wrap the sets of wires around the hubs, respectively.

Figure 2:
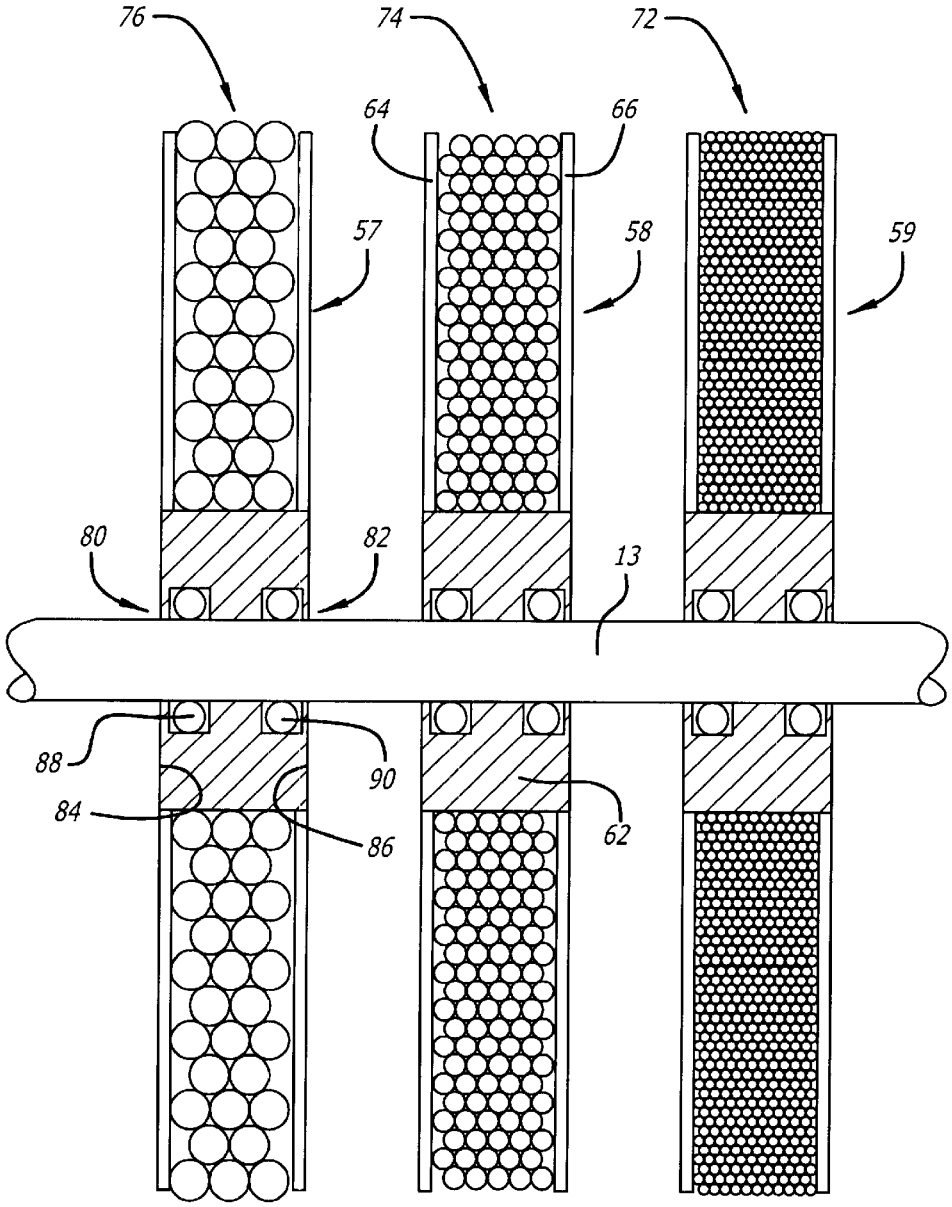
FIG. 2 is a partial sectional view of the multi-compartment paralleling reel illustrating different sized types of wire mounted within three independent compartments, respectively, according to one embodiment of the present invention.

FIG. 2 is a partial sectional view of the multi-compartment paralleling reel illustrating different sized types of wire mounted within three independent compartments, respectively, according to one embodiment of the present invention. As shown particularly in FIG. 2, each hub 62 of each independent compartment can store a set of wire. For example, independent compartment 59 can store a smaller sized diameter wire 72, independent compartment 58 can store a medium sized diameter wire 74, and independent compartment 57 can store a larger sized diameter wire 76.

The shaft 13 mounted through the plurality of independent compartments 55, 56, 57, 58, and 59, respectively, allows each independent compartment to rotate relative to the shaft and allows each independent compartment to rotate independently of the other independent compartments, respectively. The shaft 13 extends transversely through aligned holes 80 and 82 contained within first and second sides 84 and 86 of each hub 62, respectively. Moreover, the shaft 13 extends through bearings 88 and 90 contained within each hub 62, near the first and second sides 84 and 86, respectively. The bearings 88 and 90 of each hub 62 allow each independent compartment to rotate freely relative to the shaft 13. Alternatively, bushings can be used in lieu of bearings. Also, as previously discussed, the shaft 13 rotatably mounts the independent compartments of the multi-compartment paralleling reel 10 to the platform 12.

With the configuration of the multi-compartment paralleling reel 10 of the present invention, each set of wire can be drawn from each independent compartment 55 . . . 59 of the multi-compartment paralleling reel independently of the other independent compartments. Typically, during unloading, a worker draws or pulls the wire from the independent compartments for installation into a structure that needs electrical wiring, such as a building. The independent rotation of the different independent compartments allows different sets of wire to be drawn from the independent compartments at different rates of speed or the same speed, depending upon the desires of the workers pulling the wires from the independent compartments. Accordingly, workers can unload different sets of wire having the same diameter size, or different diameter sizes (e.g. wire sets 72, 74, 76), from the multi-compartment paralleling reel, at a desired speed, independently of one another and the other sets of wire. For example, workers can simultaneously unload different sets of wire having different diameter sizes (e.g. wire sets 72, 74, 76) at the same speed. This results in a significant increase in efficiency for workers trying to unload wires having different diameter sizes in unison as opposed to previous types of standard paralleling reels.

Referring to FIG. 1, the multi-compartment paralleling reel 10 further includes a reel securing bar 94 having a rectangular head 95 and a hollow shaft 96 that can be placed transversely through the independent compartments 55 . . . 59 to secure the independent compartments to one another. Particularly, the reel securing bar 94 can be placed through aligned holes 97 and 98 contained within the first and second sides of each hub 62 of each independent compartment, respectively.

The reel securing bar 94 is used to secure the independent compartments 55 . . . 59 to one another when different sets of wire are loaded onto the independent compartments, respectively. A wire of a set of wire can be looped through the arbor holes 68 and 70 of a hub 62 to fix the wire onto the hub. After fixing wires to hubs, the sets of wire can then be loaded onto the hubs of the independent compartment, respectively, by the motor 14 turning the independent compartments of the multi-compartment paralleling reel 10 together, in unison, the independent compartments being secured together by the reel securing bar 94, to wrap the sets of wire around the hubs, respectively. On the other hand, the reel securing bar 94 is removed when wire is unloaded. The far end of the reel securing bar 94, which has a hollow shaft 96, can be placed over the reel securing bar storage 36 to store the reel securing bar.

When the reel securing bar 94 is removed, this allows the independent compartments 55 . . . 59 to rotate independently of one another, about the shaft 13, such that workers can draw the different sets of wire, possibly having different diameter sizes (e.g. wire sets 72, 74, 76), from the independent compartments at any desired speed (e.g. different speeds or the same speed). The weight and friction of the shaft keeps the shaft in a basically fixed position relative to the independent compartments such that the independent compartments can rotate freely about the shaft. For example, workers can simultaneously unload different sets of wire having different diameter sizes (e.g. wire sets 72, 74, 76) at the same speed, which results in a significant increase in efficiency for workers trying to unload wires having different diameter sizes in unison.

Figure 3:
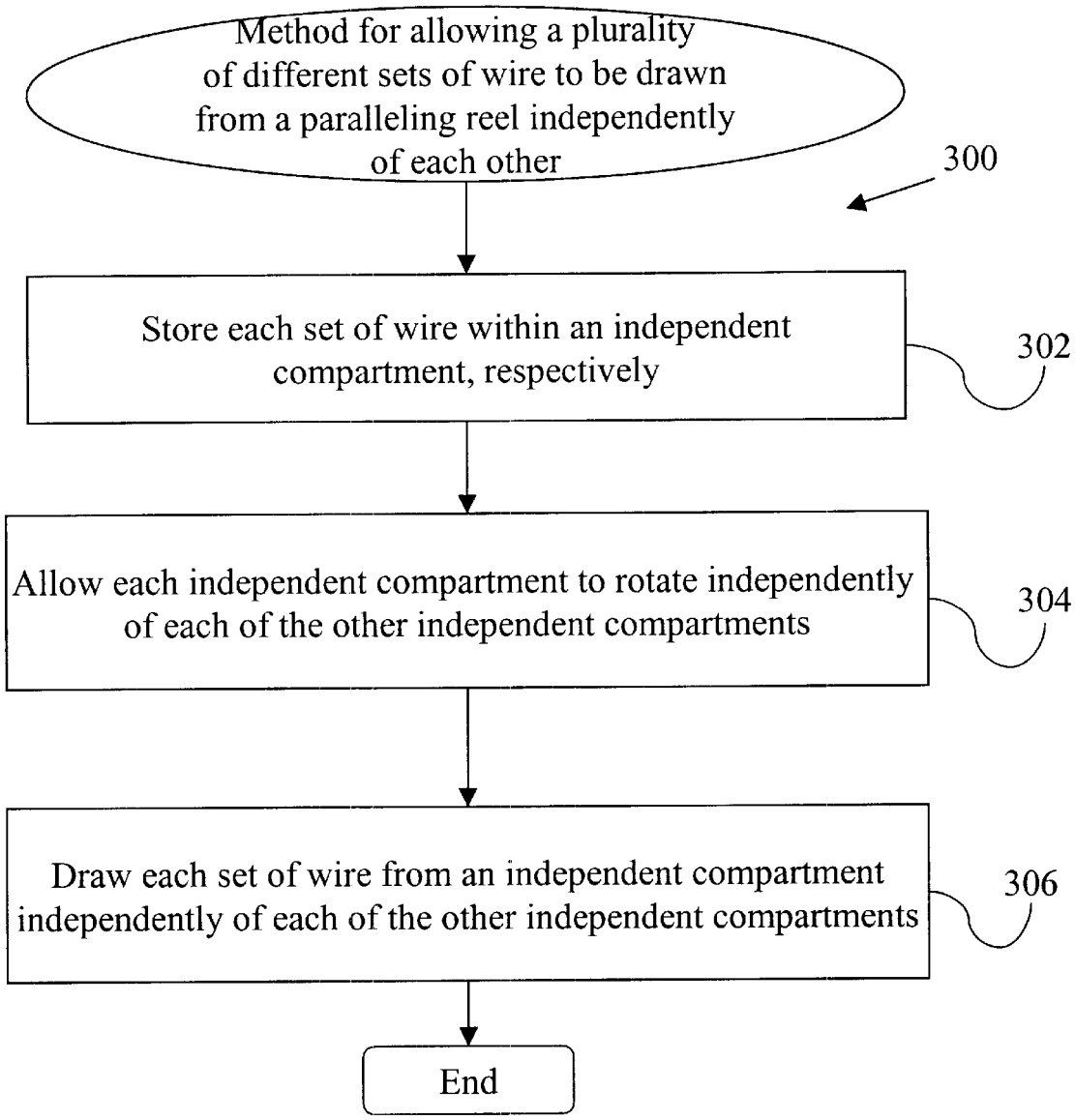
FIG. 3 is a flowchart illustrating a process for allowing a plurality of different sets of wires to be drawn from a paralleling reel independently of each other according to one embodiment of the present invention.
Figure 4:
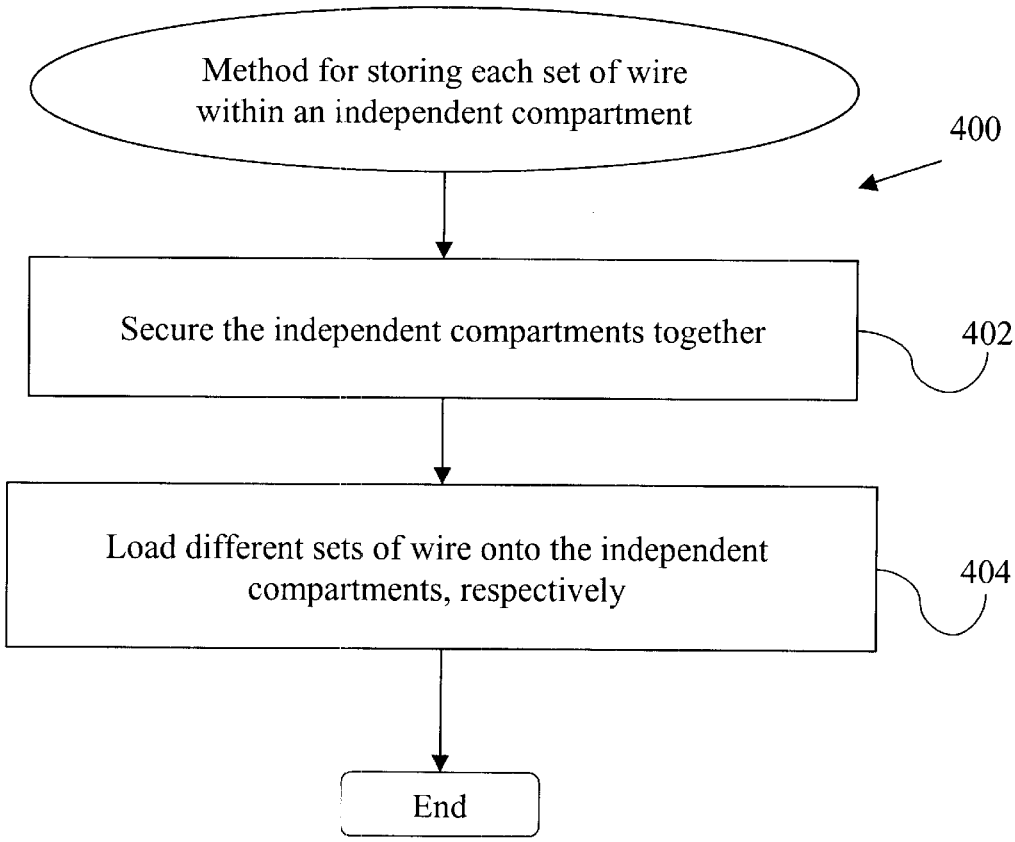
FIG. 4 is a flowchart illustrating a process for storing a set of wire within an independent compartment according to one embodiment of the present invention.

The method of use and operation of the multi-compartment paralleling reel 10, constructed as described, generally proceeds as follows. FIG. 3 is a flowchart illustrating a process 300 for allowing a plurality of different sets of wire to be drawn from a paralleling reel independently of each other according to one embodiment of the present invention. First, each set of wire is stored within an independent compartment, respectively (block 302). To accomplish this, turning to FIG. 4, which is a flowchart illustrating a process 400 for storing each set of wire within an independent compartment according to one embodiment of the present invention, the independent compartments are initially secured together (block 402). Next, the different sets of wire are loaded onto each independent compartment, respectively (block 404).

Particularly, as shown in FIG. 1, the reel securing bar 94 is placed through the holes 97 and 98 of the independent compartments 55 . . . 59 to secure the independent compartments to one another. A wire of a set of wire can be looped through the arbor holes 68 and 70 of a hub 62 to fix the wire onto the hub of the independent compartment. After fixing wires to hubs, the sets of wire can then be loaded onto the hubs of the independent compartments, respectively, by the motor 14 turning the independent compartments of the multi-compartment paralleling reel 10 together, in unison, to wrap the sets of wire around the hubs, respectively.

Continuing with reference to FIG. 3, to unload the wire, each independent compartment is allowed to rotate independently of each of the other independent compartments (block 304) and each set of wire is drawn from an independent compartment independently of each of the other independent compartments (block 306). Particularly, with reference also to FIGS. 1 and 2, the reel securing bar 94 can be removed from the independent compartments 55 . . . 59 allowing the independent compartments to rotate independently of one another, about the shaft 13, such that workers can draw the different sets of wire, possibly having different diameter sizes (e.g. wire sets 72, 74, 76), from the independent compartments at any desired speed. Accordingly, workers can unload different sets of wire having the same diameter size, or different diameter sizes, from the multi-compartment paralleling reel, at a desired speed (e.g. different rates of speed or the same rate of speed), independently of one another and the other sets of wire. For example, workers can simultaneously unload different sets of wire having different diameter sizes (e.g. wire sets 72, 74, 76) at the same speed, which results in a significant increase in efficiency for workers trying to unload wires having different diameter sizes in unison.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. A multi-compartment paralleling reel for allowing a plurality of different sets of wire to be drawn from the multi-compartment paralleling reel independently of each other, comprising:

a plurality of independent compartments, each independent compartment to store one set of wire of the plurality of different sets of wire;

a shaft mounted through the plurality of independent compartments to allow each independent compartment to rotate relative to the shaft and to allow each independent compartment to rotate independently of each of the other independent compartments;

a reel securing bar insertable transversely through aligned holes of each of the independent compartments to secure the independent compartments to one another; and wherein each set of wire of the plurality of different sets of wire is drawable from each independent compartment independently of each of the other independent compartments.

2. The multi-compartment paralleling reel of claim 1, wherein one set of wire stored by one of the independent compartments is drawable from the one independent compartment at a different rate of speed than the other different sets of wire stored by the other plurality of independent compartments.

3. The multi-compartment paralleling reel of claim 1, wherein the different sets of wire each stored by one of the independent compartments, including at least one of the different sets of wire having a different wire diameter size than the other different sets of wire, are drawable from the independent compartments at the same rate of speed.

4. The multi-compartment paralleling reel of claim 1, wherein the reel securing bar is used to secure the independent compartments to one another when different sets of wire are loaded onto the independent compartments.

5. The multi-compartment paralleling reel of claim 1, wherein, when the reel securing bar is decoupled from the independent compartments, the independent compartments rotate independently of one another such that each set of wire of the plurality of different sets of wire is drawable from each independent compartment independently of each of the other independent compartments.

6. The multi-compartment paralleling reel of claim 1, wherein the multi-compartment paralleling reel includes five independent compartments.

7. The multi-compartment paralleling reel of claim 1, wherein each independent compartment includes a cylindrically shaped hub and a pair of opposed rings.

8. A method for allowing a plurality of different sets of wire to be drawn from a paralleling reel independently of each other, comprising:

storing each set of wire of the plurality of different sets of wire utilizing an independent compartment of a plurality of independent compartments;

allowing each independent compartment to rotate independently of each of the other independent compartments;

securing the independent compartments to one another utilizing a reel securing bar that extends transversely through aligned holes of each independent compartment to secure the independent compartments to one another; and wherein each set of wire of the plurality of different sets of wire is drawable from each independent compartment independently of each of the other independent compartments when the independent compartments are not secured to one another.

9. The method of claim 8, wherein one set of wire stored by one of the independent compartments is drawable from the one independent compartment at a different rate of speed than the other different sets of wire stored by the other plurality of independent compartments.

10. The method of claim 8, wherein the different sets of wire each stored by one of the independent compartments, including at least one of the different sets of wire having a different wire diameter size than the other different sets of wire, are drawable from the independent compartments at the same rate of speed.

11. The method of claim 8 wherein allowing each independent compartment to rotate independently of each of the other independent compartments includes utilizing a shaft mounted through the plurality of independent compartments.

12. The method of claim 8, further comprising loading different sets of wire onto the independent compartments after securing the independent compartments to one another.

13. The method of claim 8, further comprising:

releasing the independent compartments from one another by decoupling the reel securing bar; and unloading different sets of wire from the independent compartments, wherein the independent compartments rotate independently of one another such that each set of wire of the plurality of different sets of wire is drawable from each independent compartment independently of each of the other independent compartments.

14. The method of claim 8, wherein the plurality of independent compartments include five independent compartments.

15. The method of claim 8, wherein each independent compartment includes a cylindrically shaped hub and a pair of opposed rings.

* * * * *

US006435450C1

(12) EX PARTE REEXAMINATION CERTIFICATE (10740th)

United States Patent
Shields et al.

(10) Number: US 6,435,450 C1
(45) Certificate Issued: Oct. 19, 2015

(54) MULTI-COMPARTMENT PARALLELING REEL HAVING INDEPENDENT COMPARTMENTS

(75) Inventors: John Shields, Glendale, CA (US); Steve Szalay, La Vern, CA (US); Cliff Thompson, Murrieta, CA (US)

(73) Assignee: SASCO, Fullerton, CA (US)

Reexamination Request:
No. 90/013,118, Feb. 5, 2014

Reexamination Certificate for:

| | |
|---|---|
| Patent No.: | **6,435,450** |
| Issued: | **Aug. 20, 2002** |
| Appl. No.: | **09/726,888** |
| Filed: | **Nov. 30, 2000** |

(51) Int. Cl.

| | |
|---|---|
| ***B65H 49/00*** | (2006.01) |
| ***B65H 49/36*** | (2006.01) |
| ***B65H 75/20*** | (2006.01) |
| ***B65H 75/02*** | (2006.01) |
| ***B65H 75/18*** | (2006.01) |
| ***B65H 49/32*** | (2006.01) |
| ***B65H 75/14*** | (2006.01) |

(52) U.S. Cl.
CPC ..... *B65H 75/146* (2013.01); *B65H 49/32* (2013.01); *B65H 49/36* (2013.01); *B65H 75/02* (2013.01); *B65H 75/20* (2013.01); *B65H 2402/412* (2013.01)

(58) Field of Classification Search
None
See application file for complete search history.

(56) References Cited

To view the complete listing of prior art documents cited during the proceeding for Reexamination Control Number 90/013,118, please refer to the USPTO's public Patent Application Information Retrieval (PAIR) system under the Display References tab.

*Primary Examiner* — Cary Wehner

(57) ABSTRACT

A multi-compartment paralleling reel that allows different sets of wire to be drawn from the paralleling reel independently of each other. The multi-compartment paralleling reel includes a plurality of independent compartments. Each independent compartment can store a set of wire. A shaft mounted through the plurality of independent compartments allows each independent compartment to rotate relative to the shaft and allows each independent compartment to rotate independently of the other independent compartments. Thus, each set of wire can be drawn from each independent compartment of the multi-compartment paralleling reel independently of the other independent compartments. This allows the different sets of wire, which may include wires that have different diameter sizes, to be drawn from the independent compartments at different rates of speed or the same speed, depending upon what is desired.

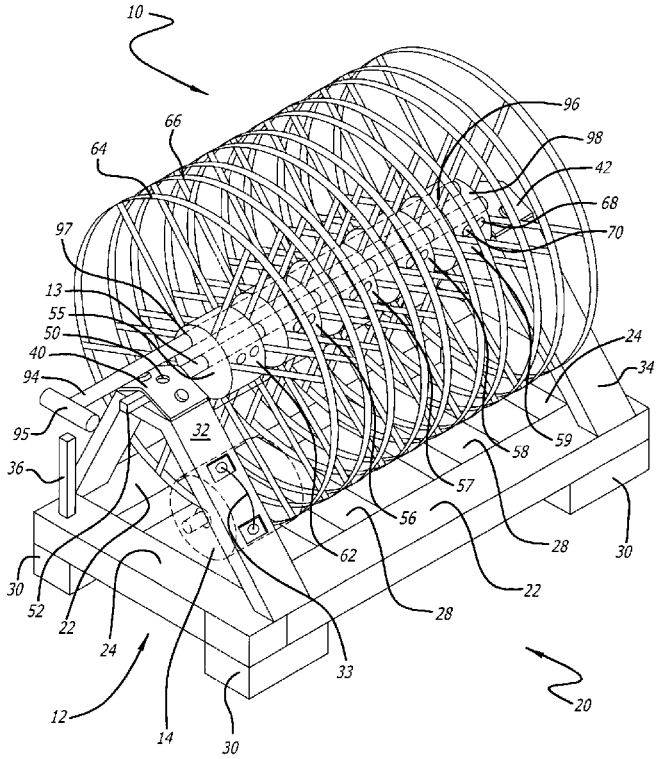

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

The patentability of claim 12 is confirmed.

Claims 1-11 and 13-15 are cancelled.

* * * * *